US005493993A

United States Patent [19]

Carter et al.

[11] Patent Number: 5,493,993

[45] Date of Patent: Feb. 27, 1996

[54] DECOY

[75] Inventors: G. Clifford Carter, Waterford; Philip G. Clarke, Groton, both of Conn.

[73] Assignee: The United States of America as represented by the Secretary of the Navy, Washington, D.C.

[21] Appl. No.: 377,662

[22] Filed: Jan. 23, 1995

[51] Int. Cl.[6] ..... B63G 8/00

[52] U.S. Cl. ..... 114/312; 114/326; 114/328

[58] Field of Search ..... 114/312, 313, 114/326, 328, 54, 242, 244, 253, 331; 441/30, 20, 31; 367/1; 116/26, 27

[56] References Cited

U.S. PATENT DOCUMENTS

| | | | |
|---|---|---|---|
| 1,097,700 | 5/1914 | Whiting | 114/331 |
| 1,718,704 | 6/1929 | Plummer | 114/54 |
| 2,534,716 | 12/1950 | Hudspeth et al. | 441/20 |
| 3,063,395 | 11/1962 | Brown | 114/331 |
| 3,175,525 | 3/1965 | De Vries | 441/31 |
| 3,771,115 | 11/1973 | Mclinden, Jr. | 367/1 |
| 3,933,109 | 1/1976 | Boisrayon et al. | 114/328 |

*Primary Examiner*—Sherman Basinger

*Attorney, Agent, or Firm*—Michael J. McGowan; James M. Kasischke; Prithvi C. Lall

[57] ABSTRACT

A decoy capable of assuming the shape of a water craft comprises a maneuverable vessel, having a tubular body portion which defines an enclosed interior region. The vessel further has an opening formed in the body portion and a hatch door which covers the opening. An energy source powers the operation of the vessel, and a drive module propels the vessel under the water. A selectively deployable bladder is stored within the vessel in its interior region and is selectively deployable from a stowed position in which the bladder is contained within the interior region of the vessel to a deployed position in which the bladder exits the vessel through the opening and is inflated with gas for assuming the shape of a water craft. An inflation system inflates the bladder with gas when deploying the bladder. The decoy can also be provided with electromagnetic, infrared and acoustic decoy projectors for projecting the characteristics of the water craft.

18 Claims, 2 Drawing Sheets

DECOY

STATE OF GOVERNMENT INTEREST

The invention described herein may be manufactured and used by or for the government of the United States of America for governmental purposes without the payment of any royalties thereon or therefore.

BACKGROUND OF THE INVENTION (1) Field of the Invention

The instant invention relates generally to decoys involved in military operations, and more specifically to a decoy capable of assuming the shape of a submersible vessel.

(2) Description of the Prior Art

The purpose of decoys is to distract and divert enemy forces from friendly forces, and thereby act as a force multiplier. The projection of power from sea including covert insertion and extraction of special units, such as Navy Seals, from craft (e.g., surface, subsurface and air craft), is a desirable effect in littoral conflicts. Decoys are needed to distract enemy forces during these type of covert operations.

The deployment of decoys resembling naval craft, such as an attack submarine, aids in projecting power from the sea. During littoral conflicts, it has been shown that enemy forces will seek out and attempt to destroy crafts which project naval power. Presently, there are small acoustical decoys which project the noise of large submersible vessels or which broadcast false messages. Reference can be made to U.S. Pat. Nos. 2,931,031 (Deloraine et al.), 3,093,107 (Grand et al.), 3,841,219 (Schillreff), 3,959,766 (Nees et al.), 4,047,592 (Sieber et al.), 4,194,246 (Crist), 4,200,859 (Evans et al.); 4,207,626 (Wedding et al.) and 5,117,731 (Mendenhall) for such acoustic decoys and the like. However, these acoustical decoys can easily be identified in littoral waters, and once identified as only acoustical decoys, they do not serve their purpose of distracting and diverting the enemy. Thus, there is presently a need for a decoy which not only projects the acoustical characteristics of a submersible vessel but also appears to be a submersible vessel, either by sight or by radar.

SUMMARY OF THE INVENTION

Accordingly, among the several objects of the present invention are the provision of an improved decoy which is capable of appearing as a submersible or surface vessel in addition to projecting the acoustical characteristics thereof; the provision of such a decoy capable of projecting other acoustical projections, such as false electromagnetic reports and false radar readings; the provision of such a decoy which is capable of being launched by sea or by air; and the provision of such a decoy which is simple in design, and easy and cost-efficient to manufacture.

Briefly, the decoy of the present invention comprises a vessel, capable of maneuvering in water, having a tubular body portion which defines an enclosed interior region. The vessel further has an opening formed in the body portion and a hatch door movable between a closed position in which the hatch door covers the opening and an open position in which the hatch door is away from the opening for allowing access into the interior region of the vessel. An energy source powers the operation of the vessel, and a drive module propels the vessel through water. A selectively deployable bladder is stowed within the vessel. The bladder assumes a deployed position when it exits the vessel through the opening in the body portion and is inflated with gas for assuming the shape of a submersible vessel. An inflation system inflates the bladder with gas to the shape of a submersible vessel. An alternate embodiment inflates tubular ribs with gas, and a larger bladder cavity is filled with water.

The decoy of the present invention may also be provided with a communications module having both communications and acoustic decoy means for projecting the acoustical characteristics of a submersible vessel. As with the bladder, the communications module is selectively deployable with the bladder from a stowed position in the interior region of the vessel. The deployed position of the module involves releasing the module from the vessel through the opening in the body portion and tethering it to the inflatable bladder.

Other objects, features and advantages of the invention shall become apparent as the description thereof proceeds when considered in connection with the accompanying illustrative drawings.

BRIEF DESCRIPTION OF THE DRAWINGS

A more complete understanding of the invention and many of the attendant advantages thereto will be readily appreciated as the same become better understood by reference to the following detailed description when considered in conjunction with the accompanying drawings wherein.

Corresponding reference numerals designate corresponding parts throughout the drawings.

DESCRIPTION OF THE PREFERRED EMBODIMENT

Figure 1:
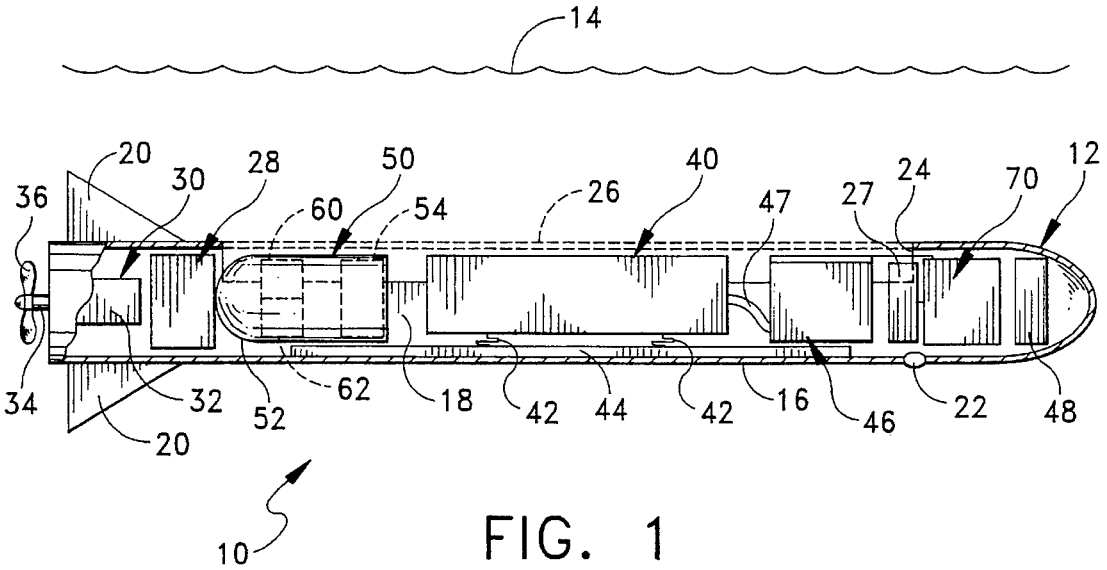
FIG. 1 is a partial cross-sectional schematic view of a decoy in its pre-deployed configuration.
Figure 2:
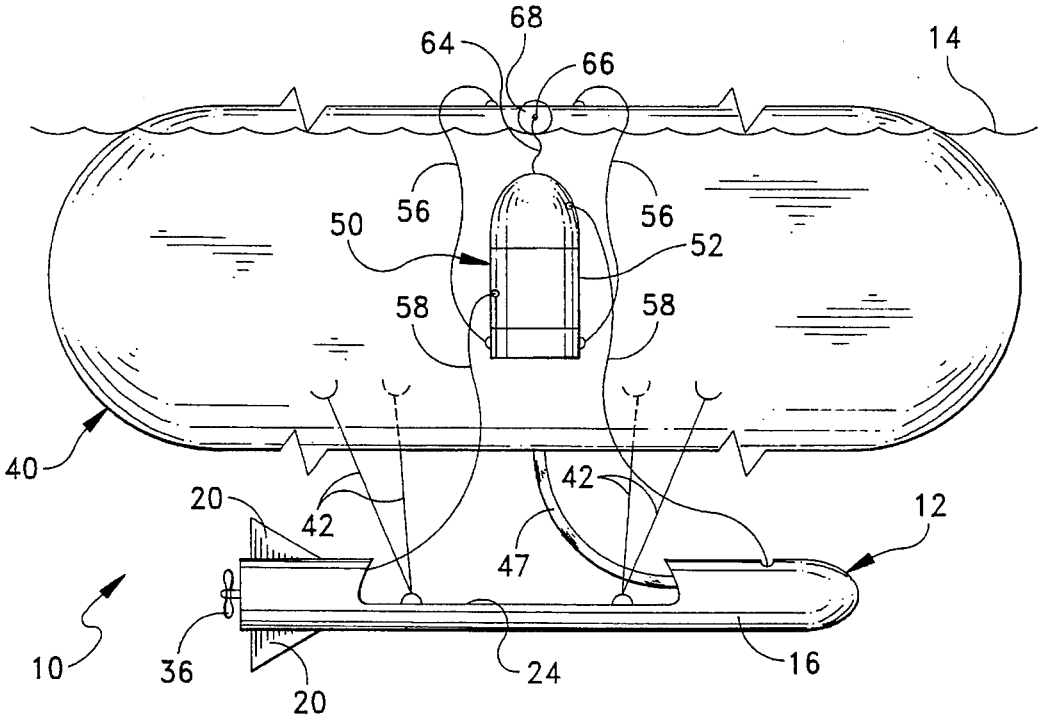
FIG. 2 is an elevational schematic view of the decoy in its deployed configuration.

Referring now to the drawings, there is generally indicated at 10 a decoy which is capable of assuming the shape of a submersible vessel, such as a submarine. Decoy 10 is further capable of projecting the acoustical characteristics of a submersible vessel. FIG. 1 illustrates decoy 10 in a pre-deployed configuration and FIG. 2 illustrates it in a deployed configuration.

Referring now to FIG. 1, decoy 10 comprises a torpedo-shaped vessel, generally indicated at 12, which is capable of maneuvering in water 14. Vessel 12 comprises a tubular body portion 16 which defines an enclosed interior region 18, and two or more fins 20 which stabilize the vessel 12 as it travels under the surface of the water 14. Preferably, vessel 12 is approximately twenty-one inches in diameter and ten feet long, the vessel being constructed and arranged for being launched from a torpedo tube (not shown) of a launching craft, such as a submarine, ship or aircraft. An alternative six inch by eighteen inch embodiment for small decoys is possible. Reference should be made to standard torpedo designs for the construction details and exterior shape of the vessel. An explosive chamber 22 is located on the underside of the body portion 16. Explosive is joined to a control device described in greater detail below for scuttling vessel 12 upon receipt of a command, after a preset time period, or upon the occurrence of a specific event.

As illustrated, an opening 24 is constructed in the body portion 16 of vessel 12 for accessing the interior region 18 of the vessel 12. A hatch door 26 (illustrated in broken lines in FIG. 1) covers the opening, and an actuator 27 mechanically joined to the hatch door 26 and vessel 12 for moving the hatch door 26 between a closed position in which the hatch door 26 covers the opening 24 and an open position in which the hatch door 26 is away from the opening 24 for allowing access into the interior region 18 of the vessel 12. Hatch door 26 can be attached to the body portion 16 in any suitable manner so long as it can be quickly and efficiently moved away by the actuator 27 from the opening 24 when deploying the decoy 10. In order to maintain consistent flow of water over the body portion 16 of the vessel 12 as it travels through the water 14, hatch door 26 is faired to the outer surface of the body portion 16.

Decoy 10 includes a power source, generally indicated at 28, such as a battery or fuel cell, suitable for powering the operation of vessel 12 through water 14. As illustrated, power source 28 powers the operation of a drive module, generally indicated at 30, which propels the vessel 12 through the water 14. Drive module 30 comprises a suitable motor 32 which rotates a drive shaft 34 having a propeller 36 mounted thereon. As mentioned briefly above, vessel 12, including its power source 28 and drive module 30, may be constructed in accordance with any standard torpedo design.

Provided within the interior region 18 of the body portion 16 of the vessel 12 is a selectively deployable bladder, generally indicated at 40, fabricated from any suitable water impermeable sheet material. Not only should the material comprising the bladder 40 be water impermeable, but it should also be radar reflective so that it triggers enemy radar scanners. Bladder 40 is strategically folded and contained within the interior region 18 of the vessel 12 in a stowed position so that upon its deployment, the bladder 40 exits the vessel 12 through the opening 24 in the body portion 16 and is inflated with gas (e.g., air) for assuming the shape of a submersible vessel (see FIG. 2). In an alternate embodiment, (see FIG. 3) a plurality of tubular ribs are inflated with gas and a larger bladder cavity is filled with water. Preferably, when inflated, bladder 40 is sized for assuming the shape of a submarine, but it should be understood that the bladder 40 can be sized to resemble a Seal Delivery Vehicle ("SDV"), a torpedo, a mine, an Advanced Swimmer Delivery System ("ASDS") or Combat Rubber Raiding Craft ("CRRC"), the latter being a surface vessel.

Referring now to FIG. 2, means for connecting the inflatable bladder to the vessel embodies structural cabling 42 fabricated from high-strength nylon material. When deployed, bladder 40 is stabilized by the vessel 12 which has lead weights 44 mounted at the bottom of the vessel 12 for providing a righting moment to preserve the orientation of decoy 10 and for maintaining the majority of bladder 40 under the surface of water 14.

Generally indicated at 46 is an inflation system for selectively inflating bladder 40 with gas via hose 47 when it is desired to deploy decoy 10. As illustrated in FIG. 1, inflation system 46 is positioned within the interior region 18 of vessel 12 adjacent the stowed inflatable bladder 40. Suitable gas connections and valving 47 connect the inflation system 46 to bladder 40 for gas communication therebetween. Inflation system 46 can embody any suitable high pressure inflation system which is activated by a control signal. In a preferred embodiment, the launching vessel, in order to deploy the bladder 40 of the decoy 10, sends an appropriate acoustic signal which is received by a receiver 48 provided within the interior region 18 of vessel 12. The receiver 48 is in electrical communication with the inflation system 46 for receiving signals from a vessel launching the decoy 10 which in turn activates the triggering device.

Decoy 10 of the present invention further includes a communications module, generally indicated at 50, for projecting the acoustical characteristics of a submersible vessel, and in addition, false electromagnetic radio frequency communications. More specifically, the communications module 50 comprises a buoy 52 having an acoustic projector 54 (broadly "acoustical decoy means") capable of generating directional and omnidirectional acoustic signals which have the acoustical characteristics of the craft to be simulated. De-coupling connectors (not shown) link the acoustic projector 54 to the buoy 52 of the communications module 50. As with the inflatable bladder 40, the communications module 50 including the acoustic projector 54 is selectively deployable from a stowed position in which the module 50 is housed within the interior region 18 of the vessel 12, to a deployed position in which the module 50 is released from the vessel 12 through the opening 24 in the body portion 16 and tethered to the inflatable bladder as illustrated in FIG. 2 by structural cabling 56. The buoy 52 is adapted to rise near the water's surface, just below the surface as shown in FIG. 2. Communications cabling 58 provides electrical communication between the communications module 50 and the vessel 12.

The communications module 50 further comprises a radio transmitter 60 for transmitting radio signals at radio frequencies and a radar transmitter 62 for transmitting radar signals. As schematically illustrated in FIG. 1, the transmitters 60, 62 are both housed adjacent one another within the buoy 52 of the module 50 and may, in another embodiment, share a common transmitting device. Tethered to the communications module 50 by structural cabling 64 is an antenna 66 which floats on the water's surface for transmitting signals generated by the radio and radar transmitters 60, 62. The antenna 66 is attached to a buoy 68 which floats on the water's surface to radiate radio and radar signals.

A microprocessor, generally indicated at 70, controls the operation of vessel 12, communications module 50 and the deployment of inflatable bladder 40. More specifically, microprocessor 70 is in electrical communication with power source 28 and drive module 30 as well as the vessel's fin 20 actuators for controlling the movement and direction of travel of the vessel 12. Microprocessor 70 is also in communication with the receiver 48, radio transmitter 60, radar transmitter 62, and acoustic projector 54. To deploy bladder 40, microprocessor 70 is in communication with the hatch door actuators 27 and the inflation system 46. Upon receiving a signal by receiver 48, microprocessor 70 opens the hatch door 26 via actuator 27 and transmits a signal to inflation system 46. Inflation system 46 inflates bladder 40 causing buoyant forces to act on bladder 40 whereupon it exits the interior of vessel 12. Module 50 is carried out of the interior of vessel 12 by the buoyant forces acting on the bladder 40. Microprocessor 70 can also deploy bladder 40 after passage of a preset time period or in response to other internal and external conditions. Once bladder 40 is deployed, microprocessor 70 can activate acoustic projector 54 and transmitters 60 and 62 in communications module 50. The microprocessor 70 can also be joined to explosive chamber 22 to control the scuttling of the vessel 12 upon passage of a predetermined time period or occurrence of certain preset events. The microprocessor 70 can be any type of commercially available central processing unit that is capable of controlling the vessel 12, communications module 50, hatch door actuators and inflation system 46.

In operation, vessel 12 is launched by a launching vessel such as a ship or submarine through a torpedo tube in conventional fashion. The microprocessor 70 of vessel 12 can be independently programmed to follow a predetermined mission, or can be controlled by the launching vessel. Upon reaching a predetermined location suitable for distracting and diverting enemy vessels, vessel 12 deploys its inflatable bladder 40 and communications module 50 by moving the hatch door 26 to its open position thereby exposing opening 24 through which the bladder 40 and module 50 exit. Vessel 12 then activates inflation system 46 to inflate the inflatable bladder 40. The bladder 40 assumes the shape which is illustrated in FIG. 2. Communications module 50 tethered to the inflatable bladder 40 is also deployed. Once deployed, radar reflective bladder 40 is detectable by enemy aircraft or surface vessels. Upon detecting bladder 40, the enemy believes that decoy 10 is a submersible vessel, such as a submarine and is diverted to it. Moreover, the radar transmitter 62 radiates signals through broadcast module 68 which further influence the enemy into believing decoy 10 is a submarine. The communications module 50 can further issue false reports and the like by means of its radio transmitter 60 which are intended to be intercepted by the enemy. As an additional feature, a flare can be positioned in the broadcast module 68 to deceive infrared (IR) sensors. Once the decoy 10 has served its purpose, the scuttling device 22 can be activated to destroy the decoy 10.

Figure 3:
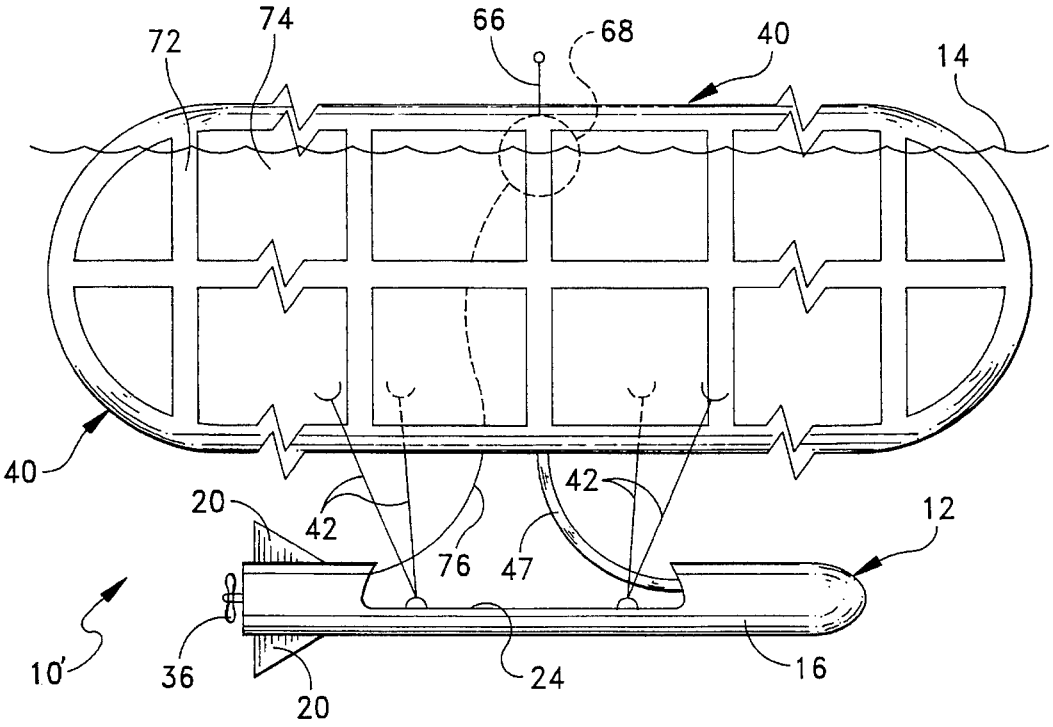
FIG. 3 is an elevational schematic view of an alternate embodiment of the decoy in its deployed configuration.

In FIG. 3 there is shown an embodiment 10' of the current invention. In this embodiment, the bladder 40 is composed of a plurality of rib members 72. When the rib members 72 are filled with gas from the inflation system 46 through the hose 47, the bladder 40 expands to form a predefined shape. As with the embodiment shown in FIG. 2 the bladder 40 is secured to the vessel 12 with structural cabling 42. Between the rib members 72 is a water permeable radar reflective membrane 74. Membrane 74 allows environmental water to fill the interior of bladder 40 while preserving the bladder 40 as an effective radar decoy. Permeability of membrane 74 can be achieved by providing membrane 74 as a mesh type material or as a material having a multiplicity of apertures therein. As an additional feature of this embodiment, communications module 50 remains in vessel 12 during deployment. Antenna 66 is deployed on buoy 68 at the surface of water 14 to allow broadcast of radio and radar. The antenna 66 is joined with communications module 50 via cable 76. Buoy 68 can be joined to vessel 12 by structural cabling or can be connected to bladder 40.

While there is shown and described herein certain specific structure embodying the invention, it will be manifest to those skilled in the art that various modifications and rearrangements of the parts can be made without departing from the spirit and scope of the underlying inventive concept and that the same is not limited to the particular forms herein shown and described except insofar as indicated by the scope of the appended claims.

What is claimed is:

1. A decoy comprising:

a vessel capable of maneuvering in water, said vessel comprising a tubular body portion which defines an enclosed interior region and has an opening formed therein;

an energy source deployed within said vessel;

a drive powered by said energy source and positioned on said vessel for propelling the vessel through water;

a selectively deployable bladder stored within the vessel, said bladder being selectively deployable from a stowed position in the interior region of the vessel to a deployed position outside the vessel, the bladder exiting the vessel through the opening, and said deployed bladder assuming the shape of a vessel;

structural cabling joined between the bladder and the vessel;

an inflation system positioned in said vessel joined to said bladder for inflating the bladder with gas when deploying the bladder; and a microprocessor housed within the vessel and joined to said inflation system for controlling bladder deployment.

2. The decoy as set forth in claim 1 further comprising an acoustic decoy means joined to said microprocessor for projecting the acoustical characteristics of a water craft on receipt of a control signal from said microprocessor.

3. The decoy as set forth in claim 2 further comprising a receiver housed within the vessel for receiving signals, said microprocessor being responsive to the signals received by the receiver for controlling bladder deployment and acoustic projection.

4. The decoy as set forth in claim 3 wherein said receiver is an acoustic receiver capable of receiving acoustic commands.

5. The decoy as set forth in claim 4 wherein said inflation system is a high pressure inflation system which is activated by an acoustic command transmitted to said receiver.

6. The decoy as set forth in claim 2 further comprising:

at least one hatch door joined to said vessel, said hatch door being positionable between a position covering the opening in the vessel body portion and a position allowing deployment of said bladder from said the vessel body portion; and an actuator means mechanically joined to the hatch door and to said vessel and in communication with said microprocessor to position said hatch door to allow deployment of said bladder from said vessel body portion on command from said microprocessor.

7. The decoy as set forth in claim 2 further comprising:

a radio transmitter powered by said power source; and an antenna deployable with said bladder and joined to said radio transmitter for transmitting radio signals at radio frequencies.

8. The decoy as set forth in claim 7 further comprising a radar transmitter electrically connected to said antenna for transmitting radar signals.

9. The decoy as set forth in claim 8 wherein said acoustic decoy means comprises an acoustic projector capable of generating directional and omnidirectional acoustic signals.

10. The decoy as set forth in claim 7 further comprising a buoy joined to said vessel by structural cabling, said antenna being positioned on said buoy.

11. The decoy as set forth in claim 7 further comprising a communications module joined to said vessel by said structural cabling and being selectively deployable from a stowed position in the interior region of the vessel to a deployed position outside said vessel, said communications module having said radio transmitter, said receiver, and said acoustic decoy means positioned therein, said communications module being selectively deployable with the bladder from a stowed position in the interior region of the vessel, to a deployed position outside the bladder, said communications module being tethered to the bladder.

12. The decoy as set forth in claim 1 further comprising lead weight strategically attached to said vessel for stabilizing said decoy by providing a righting moment.

13. The decoy as set forth in claim 1 wherein said vessel is torpedo-shaped.

14. The decoy as set forth in claim 13 wherein said vessel is constructed and arranged for being launched from a torpedo tube.

15. The decoy as set forth in claim 1 further comprising lead ballast disposed in said vessel to provide a righting moment, said bladder being a substantially gas filled structure.

16. The decoy as set forth in claim 15 wherein said bladder is fabricated from water impermeable radar reflective material.

17. The decoy as set forth in claim 1 further comprising wherein said bladder comprises a plurality of inflation members which define an enlarged structure when said bladder is deployed, said structure defining an interior having environmental water therein.

18. The decoy as set forth in claim 17 further comprising a radar reflective skin disposed on said structure defined by said bladder, said skin allowing communication of environmental water with said interior of said structure.

* * * * *